US005673561A

United States Patent [19]

Moss

[11] Patent Number: 5,673,561

[45] Date of Patent: Oct. 7, 1997

[54] THERMOACOUSTIC REFRIGERATOR

[75] Inventor: William C. Moss, San Mateo, Calif.

[73] Assignee: The Regents of the University of California, Oakland, Calif.

[21] Appl. No.: 689,445

[22] Filed: Aug. 12, 1996

[51] Int. Cl.[6] ..... F25B 9/00

[52] U.S. Cl. ..... 62/6; 62/467

[58] Field of Search ..... 62/6, 467

[56] References Cited

U.S. PATENT DOCUMENTS

| | | | |
|---|---|---|---|
| 4,825,667 | 5/1989 | Benedict et al. | 62/51.2 |
| 5,101,894 | 4/1992 | Hendricks | 62/51.2 |
| 5,295,355 | 3/1994 | Zhou et al. | 62/6 |
| 5,456,082 | 10/1995 | Keolian et al. | 62/6 |

*Primary Examiner*—Ronald C. Capossela
*Attorney, Agent, or Firm*—Henry P. Sartorio

[57] ABSTRACT

A thermoacoustic device having a thermal stack made from a piece of porous material which provides a desirable ratio of thermoacoustic area to viscous area, which has a low resistance to flow, which minimizes acoustic streaming and which has a high specific heat and low thermal conductivity is disclosed. The thermal stack is easy and cheap to form and it can be formed in small sizes. Specifically, in one embodiment, a thermal stack which is formed by the natural structure of a porous material such as reticulated vitreous carbon is disclosed. The thermal stack is formed by machining a block of reticulated vitreous carbon into the required shape of the thermal stack. In a second embodiment, a micro-thermoacoustic device is disclosed which includes a thermal stack made of a piece of porous material such as reticulated vitreous carbon. In another embodiment, a heat exchanger is disclosed which is formed of a block of heat conductive open cell foam material.

42 Claims, 6 Drawing Sheets

THERMOACOUSTIC REFRIGERATOR

The United States Government has rights in this invention pursuant to Contract No. W-7405-ENG-48 between the United States Department of Energy and the University of California for the operation of Lawrence Livermore National Laboratory.

TECHNICAL FIELD

The present claimed invention relates to the field of thermoacoustic energy conversion devices and thermoacoustic energy device fabrication. More specifically, the present claimed invention relates to an improved thermoacoustic thermal stack and heat exchanger for a thermoacoustic device and a micro-thermoacoustic device.

BACKGROUND ART

Prior art thermoacoustic devices typically use thermal stacks made from a large number of components which are assembled to form the structure of the thermal stack. The structure of the thermal stack is usually formed of a series of plates, planar sheets with openings cut into them, or grid-like cross members. Other prior art structures include elongated structures such as wires, fibers, thin rods, ribbons, etc.

It is well known in the art that a pin array thermal stack is one of the most desirable configurations for typical gasses since the curvature of the pins maximizes the relationship between thermoacoustic heat transport and viscous dissipation. Viscous dissipation occurs within a viscous penetration depth away from the solid surface while thermoacoustic effects occur mostly within a thermal penetration depth away from the surface. Thus, the curvature of the pins in a pin array thermal stack maximizes the thermoacoustic area while minimizing the viscous power dissipation.

One of the reasons that a pin thermal stack generates a favorable ratio of thermoacoustic heat transport to viscous power loss is that the surfaces of pin thermal stacks are curved. However, the ratio of thermoacoustic heat transport to viscous power dissipation is also a function of pore space between the pins. Therefore, the effects of the pore volume of the structure must be considered as well as the curvature of the elements that make up the structure. Another factor that affects the ratio of thermoacoustic heat transport to viscous power dissipation is the convexity of the gas-solid interface. The use of a structure such as a pin array creates a convex gas solid surface so as to achieve a more favorable ratio of thermoacoustic heat transport to viscous power dissipation.

Though the pin array geometry has been theoretically been shown to be superior to other geometry's for typical gasses, prior art devices have not been able to produce a pure pin array thermal stack which functions efficiently. One problem associated with pin arrays includes the fact that supporting structure is required for the pin array. The supporting structure negatively affects the efficiency of the device. Additionally, the fact that pin arrays tend to have problems associated with acoustic streaming.

With regard to the materials used to produce prior art thermal stacks, a material which has a high specific heat and low thermal conductivity is desired. Though the thermal stack material must readily absorb and radiate heat, the thermal stack material must not readily transfer heat through the thermal stack. If heat is readily transferred through the thermal stack the temperature gradient in the stack is reduced which lowers the efficiency of the thermoacoustic device. Thus, heat transfer due to thermal conductivity within the thermal stack material must be minimized so as to produce an efficient temperature gradient. Typically, stainless steel, plastic and other materials having a low thermal conductivity are used as stack materials.

Prior art thermal stacks are expensive and difficult to manufacture. For example, a roll thermal stack is typically manufactured by affixing a number of pieces of cut monofilament plastic fishing line to a thin sheet of plastic material such as mylar or kapton film which is then rolled up to form a roll thermal stack (similar in design to a jelly roll). Unfortunately, the thin plastic sheets are fragile and are not suitable for high temperature environments. In fact, none of the prior art materials typically used for forming thermal stacks are suitable for high temperature applications. The need for high temperature devices is particularly evident in applications for the oil and gas industry where electronic devices must be subjected to extreme temperatures in downhole applications.

It is believed that efficiency and gas flow can be enhanced by using novel housing and thermal stack designs. Some of the thermal stack designs used in prior art systems include various shapes other than plain cylindrical and rectangular shapes. However, manufacturing prior art thermal stacks which conform to the contours of complex shapes using prior art manufacturing and assembly methods is currently not possible.

Heat exchangers for prior art thermoacoustic devices are typically composed of disks of heat conductive material with openings formed in the disk or grids of heat conductive material which are attached to some type of a frame. A post or bar is then attached to the frame or disk to conduct the heat into and out of the thermoacoustic device. The structure of many heat exchanger designs such as the disk design and other designs based on forming openings in solid sheets of material inhibit the free flow of gas and thus reduce the efficiency of the thermoacoustic device. In addition, designs which use multiple components and complex structures such as the use of a grid and a frame are difficult and expensive to make.

There is a need for thermoacoustic devices having an extremely small size. Currently, the smallest size of thermoacoustic device available is of a length on the order of twelve inches and having a diameter of one inch. The transducers operating in such devices typically operate in the range of 500 hertz. However, there is a need for much smaller thermoacoustic devices. More specifically, thermoacoustic devices which have a length of less than fifteen centimeters and which have diameters on the order of one centimeter are needed. These miniature thermoacoustic devices are referred to as micro-thermoacoustic devices. These micro-thermoacoustic devices could be used to cool extremely small items such as single semiconductor chips or other small electronic devices. There are many applications, such as, for example, oil field electronic packages for downhole tools (where the size of the thermoacoustic device is critical).

Micro-thermoacoustic devices need to operate in the kilohertz frequency range to generate an oscillating standing wave suitable for such a small device. Micro-transducers are available, and techniques for forming heat conductors of a very small size are known. However, in the past it has not been possible to make a micro-thermoacoustic device because of the difficulty of making a thermal stack assembly of the required size. For example, a micro-transducer having a diameter of one centimeter would need a thermal stack which contains a jelly roll or a series of pins and a pin mounting structure assembled precisely such that the entire assembly would fit within the interior of the housing. The structure would require a high number of prohibitively tiny parts.

Heat exchangers for small thermoacoustic devices are difficult and expensive to make. A heat exchanger for a micro-thermoacoustic device will need multiple tiny parts that will be extremely difficult to manufacture and assemble.

Thus, a need exists for a thermoacoustic device having a thermal stack that has a greater ratio of thermoacoustic area to viscous area and which has a low resistance to flow which can be readily, easily and cheaply manufactured. Additionally, a need exists for a thermal stack material which minimizes acoustic streaming and which has a high specific heat and low thermal conductivity. Furthermore, still another need exists for a thermal stack which can be formed in a very small size, which can be made into various different shapes, and which can withstand high heat environments and high pressure environments. In addition, a heat exchanger which can be easily and cheaply made, which has minimal interference with gas flow and which can be made small enough so as to work in a micro-thermoacoustic device is needed.

DISCLOSURE OF THE INVENTION

The present invention meets the above needs with a thermal stack which provides a desirable ratio of thermoacoustic transport to viscous power loss, a stack which has a low resistance to flow, a stack which minimizes acoustic streaming and which has a high specific heat and low thermal conductivity, and a stack which is easy and cheap to manufacture. The resulting thermal stack is more durable and reliable than prior art thermal stacks. In addition, the thermal stack is easy and cheap to form and it can be formed in small sizes. The above achievement has been accomplished by using a thermal stack formed out of a piece of porous material. Heat exchangers for micro-thermoacoustic devices may also be made from solid pieces of porous material.

Specifically, in one embodiment, the thermal stack of the present invention is composed of a single piece of a porous material. The thermal stack is formed by machining the block of a porous material having a high specific heat and a low thermal conductivity into a required shape. Though the formation of the shape of the thermal stack is performed by machining a solid piece of porous material, any of a number of other methods for forming the thermal stack such as cutting, grinding, milling, etc. can be used to form the shape of the thermal stack.

In yet another embodiment, the thermal stack is formed of a carbon open cell foam such as reticulated vitreous carbon. However, other materials having the desired shapes, structures and characteristics of reticulated vitreous carbon could also be used to form the thermal stack. Reticulated vitreous carbon has a high specific heat and a low thermal conductivity and it is heat resistant. Furthermore, reticulated vitreous carbon is cheap and is easy to form.

In a still another embodiment, a micro-thermoacoustic device is disclosed. In the present embodiment, the thermal stack of the micro-thermoacoustic device is made by using a piece of porous material such as reticulated vitreous carbon. The present invention overcomes the deficiencies of prior art thermal stacks by using a single piece or block of porous material as a thermal stack. Since the thermal stack is a single block of material, there is no need to manufacture and assemble large members of tiny parts. Furthermore, the porosity and structural characteristics of the thermal stack may be easily and cheaply controlled by varying the characteristics of the material used to form the thermal stack. For example, when using reticulated vitreous carbon the pore space can be easily altered. That is, the single piece of reticulated vitreous carbon can be manufactured to have a desired number of appropriately sized pores per linear inch based upon the size and operational constraints of the thermoacoustic device. Since reticulated vitreous carbon is manufactured in various densities which are measured in units of pores per linear inch, obtaining the material necessary to form a thermal stack with the desired structural characteristics is simply a matter of using the proper raw material to form the thermal stack. In the present embodiment, heat exchangers for the micro-thermoacoustic device are made from any of a number of methods and materials. However, in the present embodiment, because heat removal is critical due to the small size of the device, perforated diamond wafers are preferably used in conjunction with diamond fingers for maximum heat removal.

In another embodiment of the present invention a heat exchanger is disclosed which is formed from a piece of porous material. The porous material would preferably be a open cell foam material having a low specific heat and a high thermal conductivity. An open cell foam such as aluminum foam, copper foam, silver foam or coated open cell foam material such as copper plated reticulated vitreous carbon, aluminum plated reticulated vitreous carbon or silver plated reticulated vitreous carbon could be used. The heat exchanger may be easily machined or cut into the required shape by machining or cutting a solid block of material. In addition, the heat exchanger may be easily cut or machined into any of a number of complex shapes. Furthermore, the heat exchanger may be easily made to a size small enough for a micro-thermoacoustic device. Moreover, by combining a stack made from a solid piece of porous material with a heat exchanger made from a solid piece of porous material, any of a number of complex shapes and difficult sizes of thermoacoustic devices may be formed.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
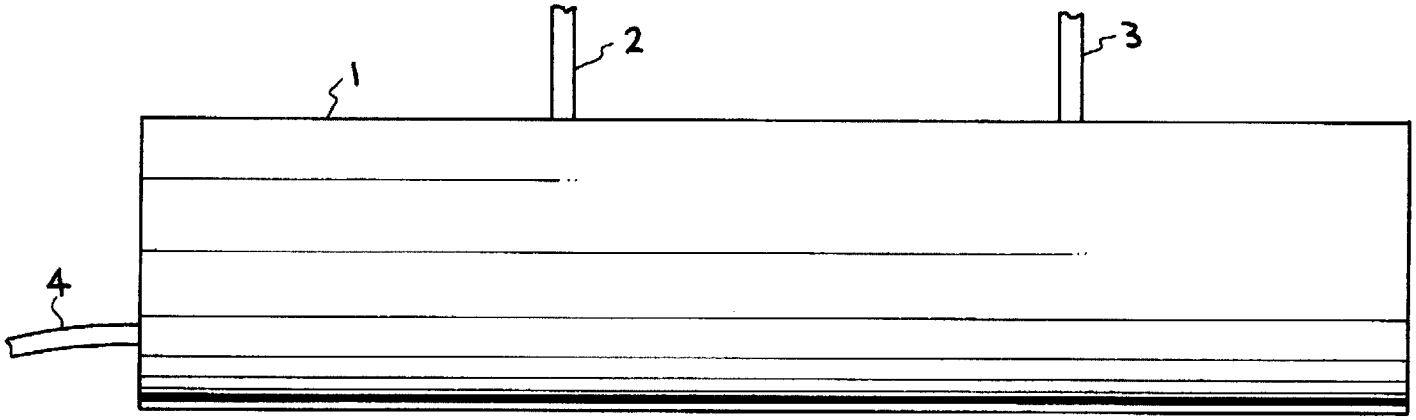
FIG. 1 is a side view illustrating a thermoacoustic device in accordance with the present invention.

With reference now to FIG. 1, a thermoacoustic device is shown which includes a housing 1. The housing 1 is shown to have a cylindrical shape. The housing 1 can be made from any material which has a low heat conductivity such as stainless steel or titanium alloy. The thermoacoustic device receives electrical power through cable 4. Heat exchanger 2 and heat exchanger 3 are shown to protrude from the housing 1. Any of a number of different devices can be cooled by the transfer of heat from the device to be cooled to heat exchanger 2. The themoacoustic device generates a temperature gradient such that heat from heat exchanger 2 is transmitted through the thermoacoustic device and is removed from the device at heat exchanger 3.

Figure 2:
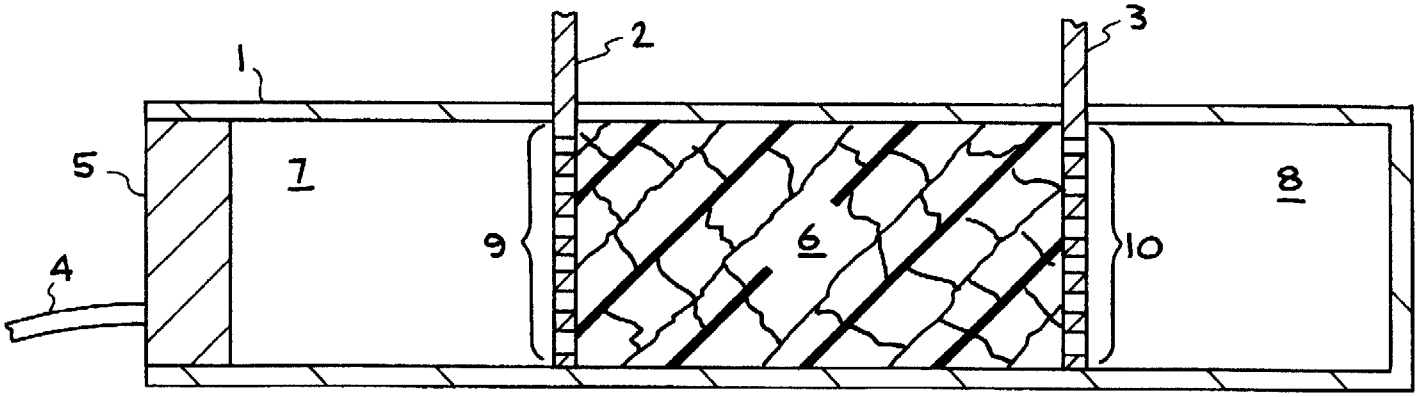
FIG. 2 is a cross sectional view of a thermoacoustic device in accordance with the present invention.

FIG. 2 is a cross sectional view of the first embodiment of the present invention. It can be seen that housing 1 has an opening at one end which receives the transducer 5 so as to form a seal enclosing a gas within the device. Any non-reactive gas could be used. However, a noble gas such as helium is preferably used in the present embodiment. Transducer 5 receives electrical power through cable 4. The thermoacoustic device further includes heat exchanger 2 and heat exchanger 3. Heat exchanger 2 includes openings, typically shown as 9, which allow the gas to freely pass through the heat exchanger 2. Heat exchanger 3 also includes openings, typically shown as 10, which allow gas to freely pass through heat exchanger 3. Disposed between heat exchanger 2 and heat exchanger 3 is thermal stack 6. In the present invention thermal stack 6 is a piece of porous material which is non-reactive, which has a high specific heat and which has a low thermal conductivity. In one embodiment of the present invention, a porous carbon material such as a carbon open cell foam, and preferably, reticulated vitreous carbon is used as the material of thermal stack 6. Reticulated vitreous carbon open cell foam material is readily available and may be purchased from suppliers such as Energy Research and Generation, Inc., Oakland, Calif. Gas fills the pore space within the thermal stack 6 and fills cylindrical space 7 which lies between the transducer 5 and the heat exchanger 2. The gas also fills cylindrical space 8 which lies between heat exchanger 3 and the end of housing 1.

Upon the application of electrical power to electrical cable 4, the transducer 5 generates a standing wave having a fixed wavelength which oscillates in time. Preferably, a transducer frequency that generates either a quarter or a half wavelength across the length of the housing 1 is used. The compression and decompression of the gas as it moves within the thermal stack 6 causes a temperature gradient to be established along the length of the thermal stack 6. As a result, a low temperature is achieved at the region of the thermal stack directly adjoining heat exchanger 2 and a higher temperature is achieved at the region of the thermal stack 6 directly adjoining heat exchanger 3. Thus, the present invention is well suited to cooling items which are placed into thermal contact with heat exchanger 2.

Figure 2A:
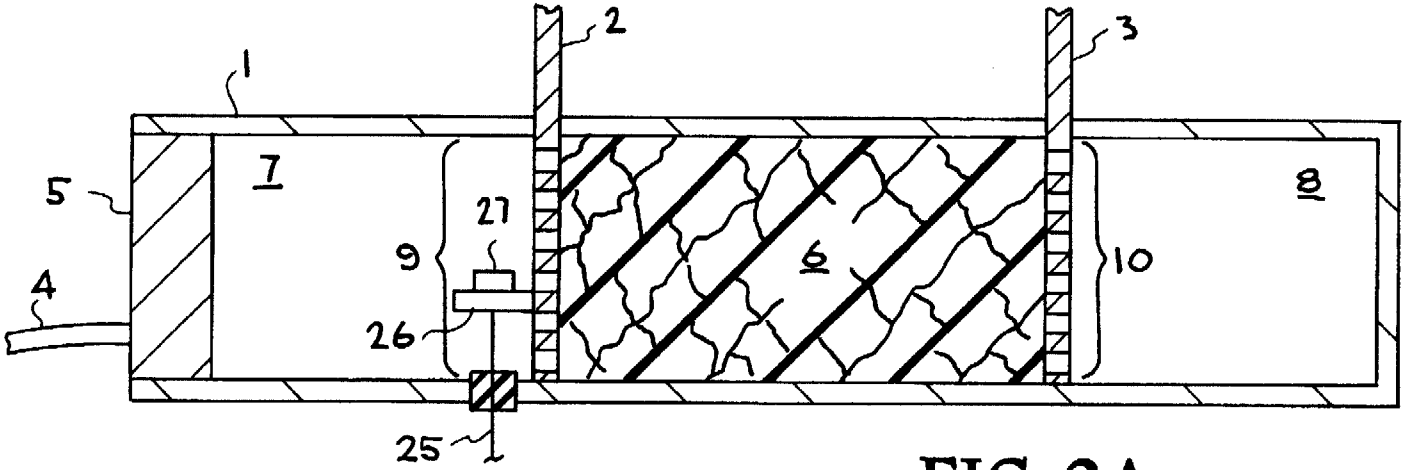
FIG. 2*a* is a cross sectional view of a thermoacoustic device for cooling a semiconductor device in accordance with the present invention.

FIG. 2*a* shows an alternate embodiment in which the device to be cooled is enclosed within the housing 1. The semiconductor device 27 is shown to be disposed within cylindrical space 7 and located in a plane perpendicular to the surface of heat exchanger 2. The semiconductor device 27 is attached to mounting board 26 which is thermally coupled to heat exchanger 2. Electrical signals are transmitted to and from semiconductor device 27 through cable 25. This configuration only covers a small region of the open region 9 of heat exchanger 2; thus, minimizing the disruption in gas flow. Electrical power is provided to the thermoacoustic device through cable 4 which is attached to transducer 5. The operation of the semiconductor device 27 generates heat which is transferred through mounting board 26 to heat exchanger 2. Because the semiconductor device 27 is attached in close proximity to the heat exchanger 2, heat may be quickly and efficiently removed from the semiconductor device 27.

Figure 3:
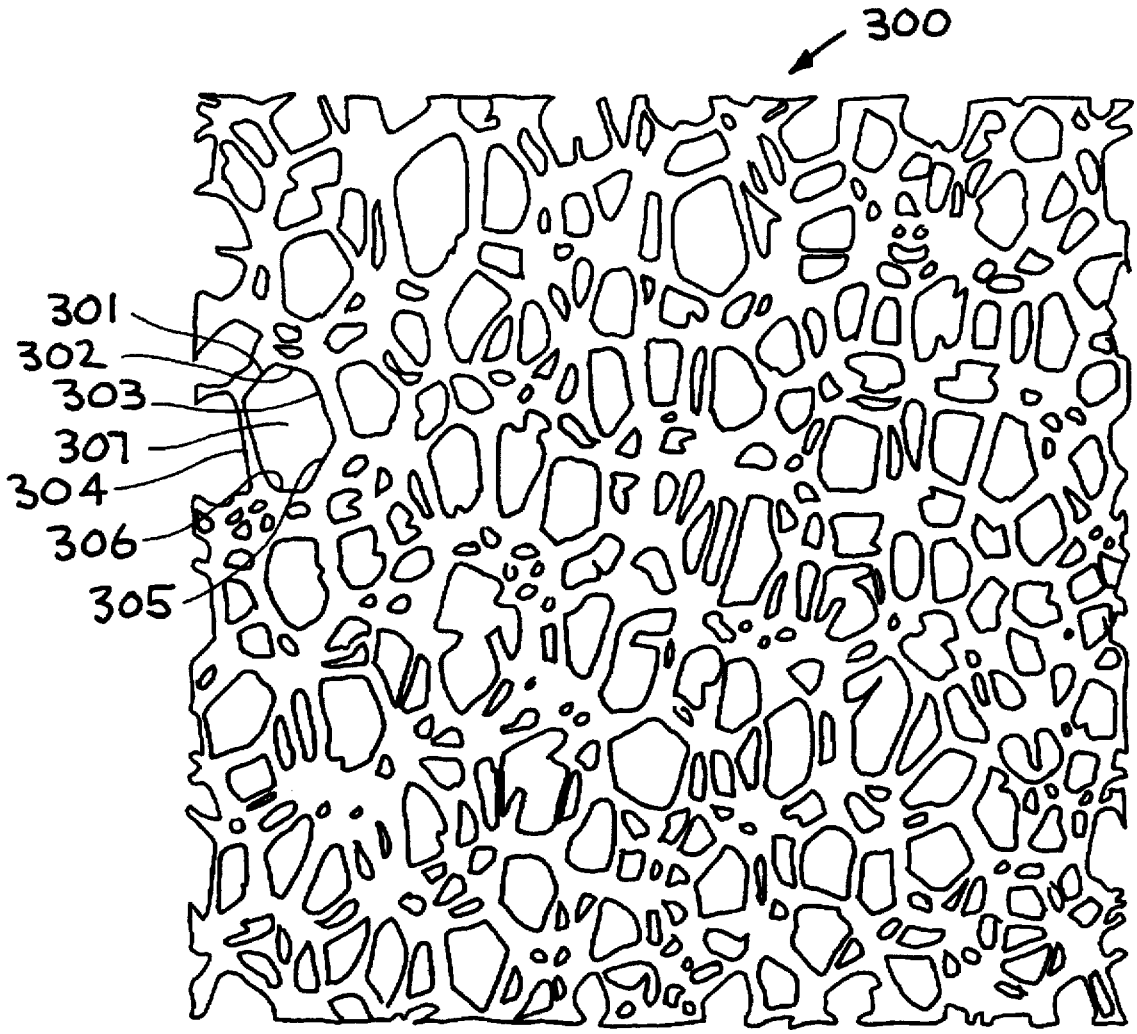
FIG. 3 is a magnified view of a portion of a thermal stack in accordance with the present claimed invention.

FIG. 3 shows an enlarged view of the structure of a piece of reticulated vitreous carbon 300. It can be seen that the piece of reticulated vitreous carbon 300 has a structure which consists of connected structural segments which form a number of pores such as structural segments, typically shown as 301–306, which form pore 307. The structural segments 301–306 connect to form a shape which is roughly circular in shape. Each of the structural segments 301–306 have various different cross sectional shapes. However, each ligament of the cross sectional shapes is generally curved so as to form structural segments 301–306 which are generally pin-shaped. The structure formed by structural segments 301–306 has a high amount of pore space per given volume. In addition, it can be seen that the structural segments 301–306 are arranged so that there is a consistently high area and thus a high thermal absorption area throughout the structure of the piece of reticulated vitreous carbon 300.

Figure 4:
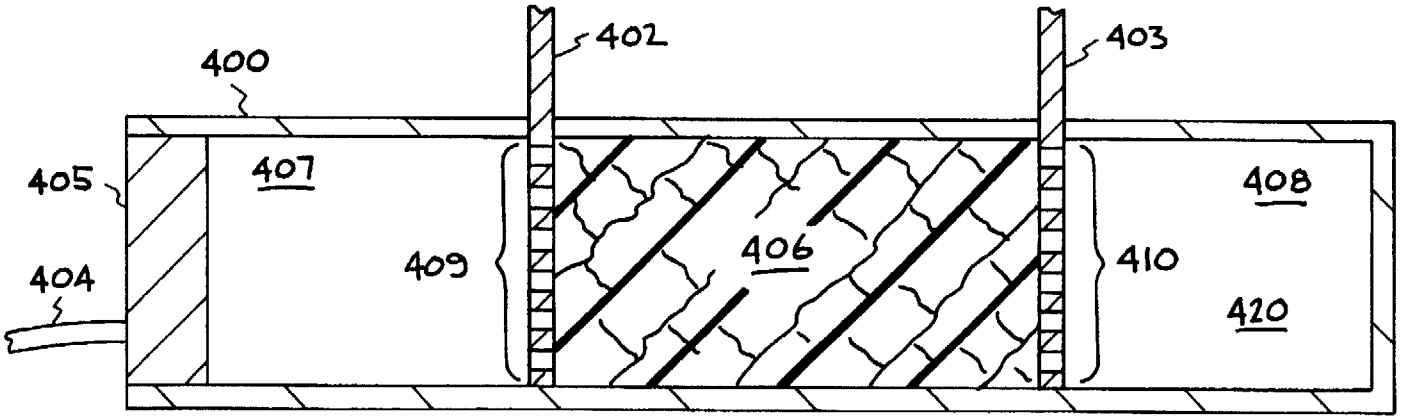
FIG. 4 is a cross sectional view of a micro-thermoacoustic device in accordance with the present claimed invention.

FIG. 4 shows a cross sectional view of a micro-thermoacoustic device which includes housing 400 having a cylindrical shape which is open at one end and which is hollow. The size of the housing 400 is approximately twelve centimeters in length and has a diameter of roughly one centimeter. The open end of the housing 400 is filled by micro-transducer 405. Micro-transducer 405 operates at a frequency in the kilohertz range. The frequency must be tailored to the length and structure of the device. However, in the present embodiment, a frequency of approximately two kilohertz may be used. Power cable 404 transfers electrical power to the transducer 405. Thermal stack 406 lies between heat exchanger 402 and heat exchanger 403. Thermal stack 406 is formed of a single piece of porous carbon material and preferably a piece of reticulated vitreous carbon shaped to fit within housing 400. Because of the higher operating frequency and the small size of the micro-thermoacoustic device, a reticulated vitreous carbon material having a high number of pores per linear inch is used. In the present embodiment, a reticulated vitreous carbon material having 60 pores per linear inch is used. Heat exchanger 402 includes openings, typically shown as 409, formed therethrough so as to allow gas to freely pass through the heat exchanger 402. Similarly, heat exchanger 403 includes openings, typically shown as 410, formed therethrough so as to allow for gas to flow through heat exchanger 403. Heat exchanger heat exchanger 403 may be formed from any of a number of materials having a high thermal conductivity. Because of the small size of the device, efficient heat transfer is very important. Therefore, heat exchanger 402 and heat exchanger 403 are made of diamond. In the present embodiments heat exchanger 402 and the heat exchanger 403 may be formed by any of a number of means. However, in the present embodiment they are formed by chemical vapor deposition of diamond material. Furthermore, in the present embodiment, removal of the heat away from the heat exchangers is achieved by the use of diamond fingers attached to the heat exchangers.

Cylindrical area 407 and cylindrical area 408 are filled with gas 420. Thermal stack 406 contains pore space which is filled with gas 420. Gas 420 is a noble gas such as helium. Openings 409 formed through heat exchanger 402 allow the gas 420 to freely pass between cylindrical region 407 and the pore space in thermal stack 406. Openings 410 formed through heat exchanger 403 allow the gas to freely pass between cylindrical region 407 and the pore space in thermal stack 406. Upon the application of electrical current to cable 404, transducer 405 generates acoustic energy which forms an oscillating wave. The oscillating wave causes the gas 420 to oscillate and be alternately compressed and expanded as it oscillates so as to store heat within portions of thermal stack 406. The oscillating wave causes heat to be transferred through the gas so as to establish a temperature gradient in the thermal stack between heat exchanger 402 and heat exchanger 403.

As a result, a low temperature is achieved at the region of the thermal stack directly adjoining heat exchanger 402 and a higher temperature is achieved at the region of the thermal stack 406 directly adjoining heat exchanger 403. Thus, the present invention is used to cool items by placing the item to be cooled in thermal contact with heat exchanger 402.

Figure 5:
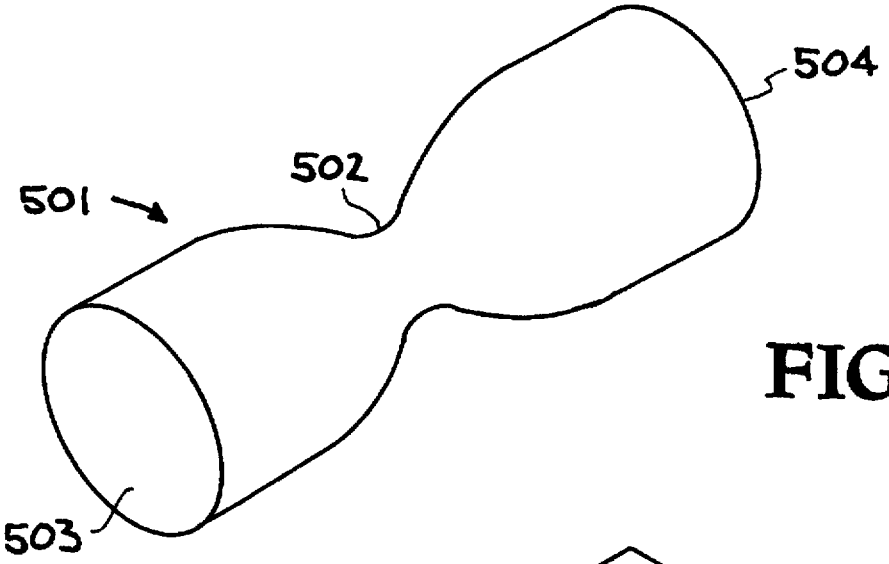
FIG. 5 is a view of a thermal stack having a severely tapered cylindrical shape in accordance with the present claimed invention.

FIG. 5 shows a thermal stack 501 having a shape which is cylindrical at end 503 and at end 504 and which tapers to a narrow flow restriction region 502. This shape is generally tapered with a severely tapered region at flow restriction region 502. This shape is easily achieved by machining a block of reticulated vitreous carbon into the desired shape.

Figure 6:
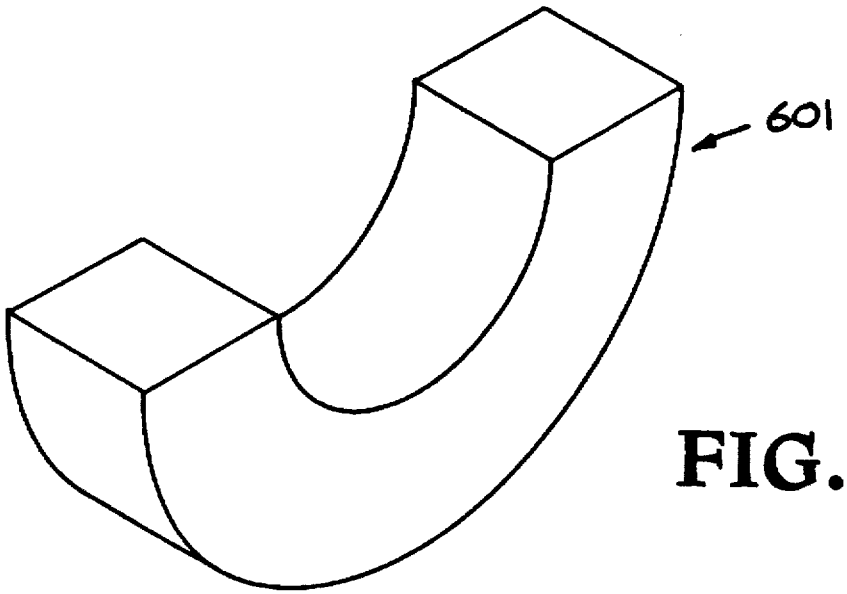
FIG. 6 is a view of a U-shaped thermal stack in accordance with the present claimed invention.

FIG. 6 shows a thermal stack 601 which has a U-shaped form. Thermal stack 601 is made of reticulated vitreous carbon. Thermal stack 601 is fabricated by machining a piece of reticulated vitreous carbon into the desired shape.

Figure 7:
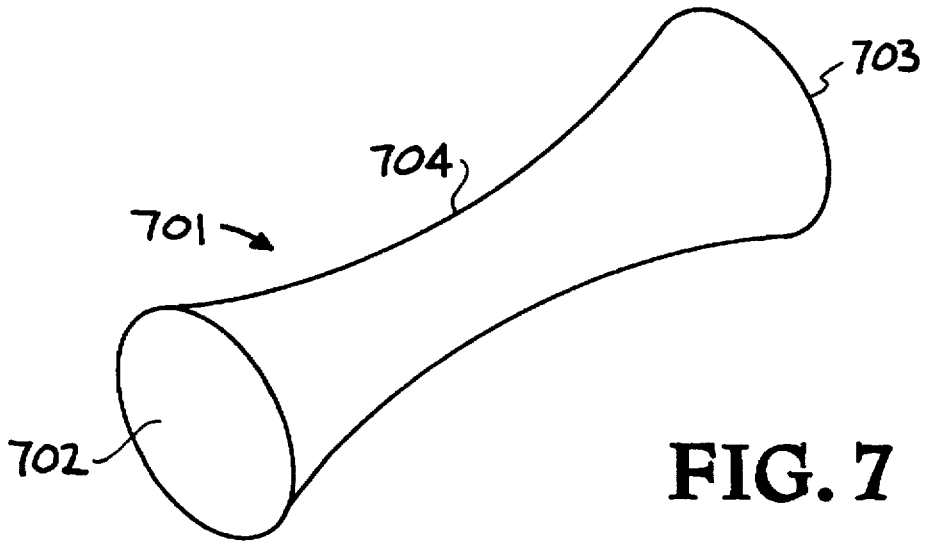
FIG. 7 is a view of a thermal stack having an inwardly tapered cylindrical shape in accordance with the present claimed invention.

FIG. 7 shows a thermal stack 701 which has a inwardly tapered cylindrical shaped form. It can be seen that thermal stack 701 tapers inwardly from end 702 to a region having a reduced diameter such as region 704 and the thermal stack 701 then tapers to end 703 which has a diameter equal to the diameter of end 702. Thermal stack 701 is made of reticulated vitreous carbon. Thermal stack 701 is fabricated by machining a piece of reticulated vitreous carbon into the desired shape.

Figure 8:
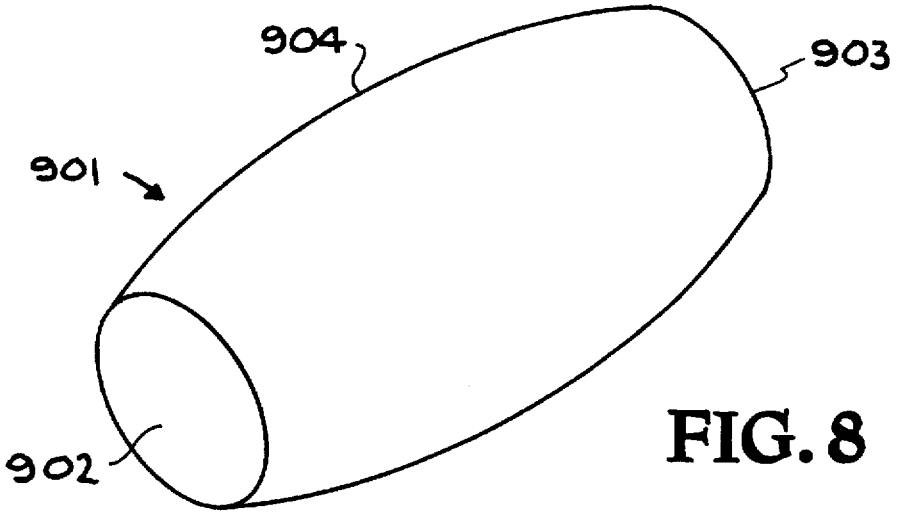
FIG. 8 is a view of a thermal stack having an outwardly tapered cylindrical shape in accordance with the present claimed invention.

FIG. 8 shows a thermal stack 901 which has a cylindrically tapered form. Thermal stack 901 includes end 902 and end 903 and tapers along it's length such that the central region of the thermal stack 901 has a diameter which is greater than the diameter of end region 902 and end region 903 of the thermal stack 901. Thermal stack 901 is made of reticulated vitreous carbon. Thermal stack 901 is fabricated by machining a piece of reticulated vitreous carbon into the desired shape.

Figure 9:
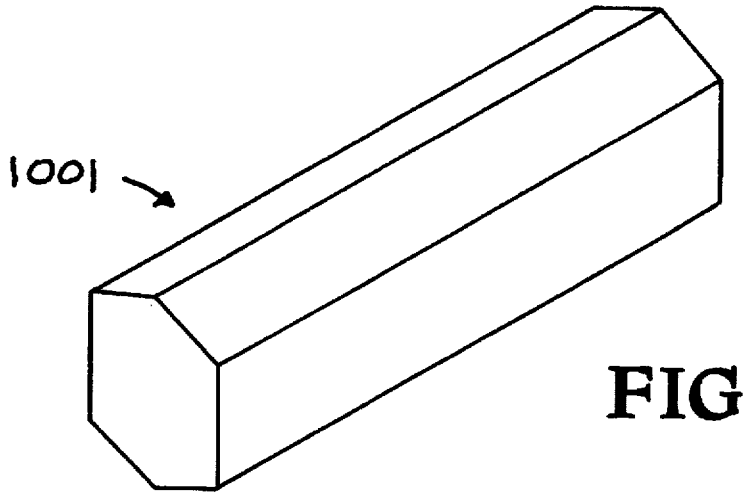
FIG. 9 is a view of a thermal stack having a hexagonal shape in accordance with the present claimed invention.

FIG. 9 shows a thermal stack 1001 which has a hexagonally shaped form. Thermal stack 1001 is made of reticulated vitreous carbon. Thermal stack 1001 is fabricated by machining a piece of reticulated vitreous carbon into the desired shape.

Figure 10:
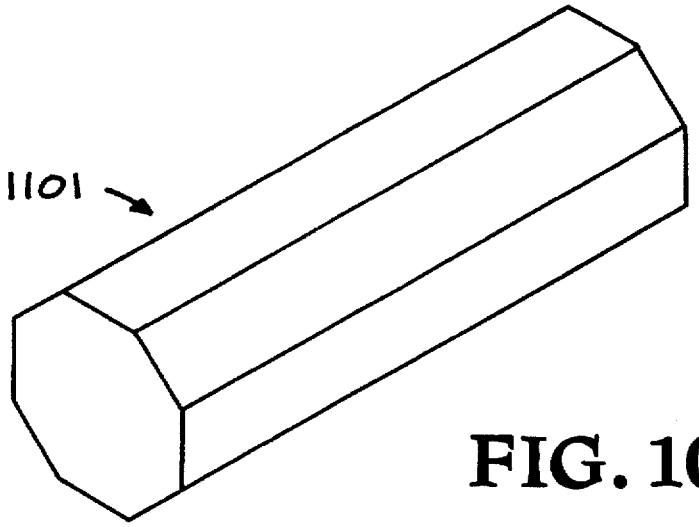
FIG. 10 is a view of a thermal stack having an octagonal shape in accordance with the present claimed invention.

FIG. 10 shows a thermal stack 1101 which has a octagonally shaped form. Thermal stack 1101 is made of reticulated vitreous carbon. Thermal stack 1101 is fabricated by machining a piece of reticulated vitreous carbon into the desired shape.

Figure 11:
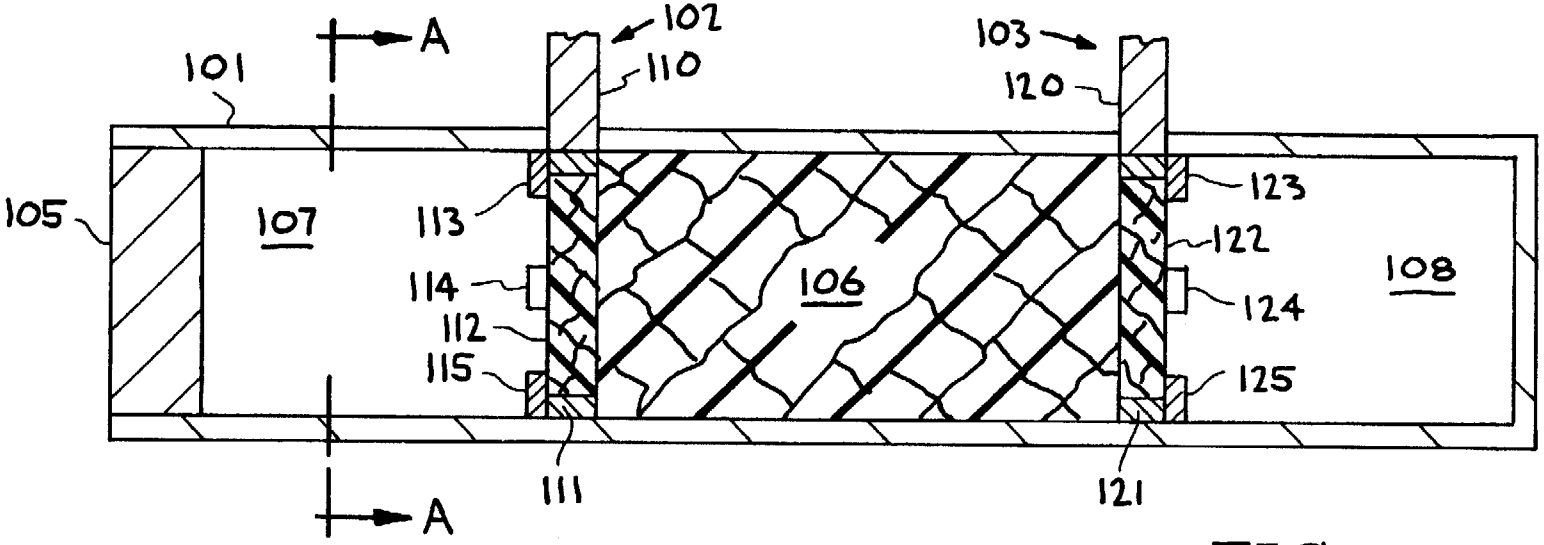
FIG. 11 is a cross sectional view of a thermoacoustic device including a heat exchanger in accordance with the present invention.

FIG. 11 shows a micro-thermoacoustic device including heat exchangers 102 and 103. Heat exchangers 102 and 103 include pieces of porous material which are machined or cut into the desired shape to form block 112 and block 122. Block 112 and block 122 are formed out of a thermally conductive open cell foam such as silver foam or copper foam or aluminum foam or a metal coated reticulated vitreous carbon material. These thermally conducting open cell foams are readily available and can be purchased from suppliers such as Astro Met in Cincinnati, Ohio and Energy Research and Generation, Inc., in Oakland, Calif. These thermally conductive materials can be obtained in various porosity's and densities. Therefore, the characteristics of the heat exchanger may be easily altered by selecting the proper material for forming the heat exchangers. Typically, a pore density of sixty pores per linear inch may be used.

The heat exchanger 102 includes block 112 which is surrounded by support ring 111. The support ring 111 is ring shaped and is made of a thermally conductive material such as copper. The block 112 is made of a thermally conductive open cell foam material. The block 112 is held in place by fingers 113–115 which connect to support ring 111. Heat is conducted into the device through conductive element 110 which is thermally connected to support ring 111. Similarly, heat exchanger 103 includes block 122 which is surrounded by support ring 121. The support ring 121 is ring shaped and is made of a thermally conductive material such as copper. The block 122 is made of a thermally conductive open cell foam material. The block 122 is held in place by fingers 123–125 which connect to support ring 121. Heat is conducted into the device through conductive element 120 which is thermally connected to support ring 121. This embodiment is described with respect to a design which includes parts such as support rings and fingers for holding the block of the heat exchanger in place. However, any of a number of other designs which contain the heat exchangers in closed proximity to the stack may be used.

Figure 12:
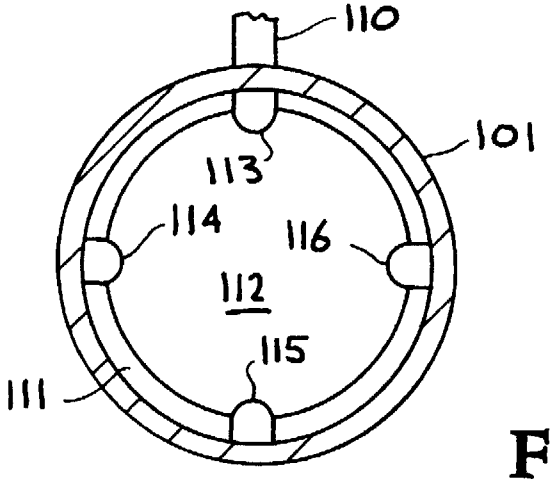
FIG. 12 is a side view along axis A—A of FIG. 11 illustrating a thermoacoustic device including a heat exchanger in accordance with the present invention.

FIG. 12 shows heat exchanger 102 located within housing 101. It can be seen that the support ring 111 fits within the housing 101 so as to contain the block 112. Each of the fingers 113–116 retain the block 112. In the event that the device to be cooled is located within the thermoacoustic device, the device to be cooled could be coupled to any one of the fingers 113–116. Conductive element 110 extends out of the housing so as to allow for heat to be conducted into the thermoacoustic device. For example, conductive element 110 could be used to cool components that are outside of housing 101 by thermally connecting the component to be cooled to conductive element 110.

The structure of heat exchanger 103 is identical to that of heat exchanger 102. The heat exchanger includes a block 122, a support ring 121, a conductive element 120 and fingers 123–126. Though conductive element 120 is shown as a single bar, any of a number of well known means for removing heat from the thermoacoustic device could be used. Other means for removing heat from a thermoacoustic device include the use of a concentric ring of cooling fins around the heat exchanger 103 or a robust thermal connection to other well known devices for removing heat. It will be noted that finger 126 is not shown in FIG. 11 as it lies directly across from finger 124.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A thermoacoustic device comprising:

a housing;

a transducer, said transducer disposed within said housing;

a first heat exchanger, said first heat exchanger disposed within said housing;

a second heat exchanger, said second heat exchanger disposed within said housing; and a thermal stack comprising a single piece of porous material, said thermal stack having pore space, said thermal stack disposed within said housing such that said thermal stack directly adjoins said first heat exchanger and such that thermal stack directly adjoins said second heat exchanger such that a gas may be dispersed throughout said housing and throughout said pore space of said thermal stack such that, upon the activation of said transducer, an oscillating wave form is produced within said gas so as to compress and decompress said gas and form a temperature gradient within said thermal stack.

2. The thermoacoustic device of claim 1 wherein said thermal stack comprises a porous carbon material.

3. The thermoacoustic device of claim 1 wherein said thermal stack comprises reticulated vitreous carbon.

4. The thermoacoustic device of claim 1 wherein said thermal stack has a shape and where said shape is formed by machining a piece of reticulated vitreous carbon.

5. The thermoacoustic device of claim 1 wherein said thermal stack has a shape and wherein said shape is cylindrical.

6. The thermoacoustic device of claim 1 wherein said thermal stack has an outer surface which has a shape and wherein said outer surface shape is the shape of a venturi tube.

7. The thermoacoustic device of claim 1 wherein said thermal stack has a shape and wherein said shape is u-shaped.

8. The thermoacoustic device of claim 1 wherein said thermal stack has a shape and said shape has two ends and a central region and wherein said diameter varies along the length of said thermal stack such that each of said ends has a diameter and such that said central region has a diameter and wherein said diameter of said central region is less than said diameter of each of said ends.

9. The thermoacoustic device of claim 1 wherein said first heat exchanger comprises a piece of thermally conductive open cell foam material.

10. The thermoacoustic device of claim 1 wherein said thermal stack has a shape and wherein said shape has two ends and a central region and wherein said diameter varies along the length of said thermal stack such that each of said ends has a diameter and such that said central region has a diameter and wherein said diameter of said central region is greater than said diameter of each of said ends.

11. The thermoacoustic device of claim 1 wherein said thermal stack has a shape and wherein said shape is hexagonal.

12. The thermoacoustic device of claim 1 wherein said thermal stack has a shape and wherein said shape is octagonal.

13. The thermoacoustic device as recited in claim 1 wherein said thermal stack comprises a piece of reticulated vitreous carbon material and wherein said thermal stack is formed by cutting a piece of reticulated vitreous carbon material.

14. The thermoacoustic device as recited in claim 1 wherein said thermal stack comprises a piece of reticulated vitreous carbon material and wherein said thermal stack is formed by machining a piece of reticulated vitreous carbon material.

15. A semiconductor package including a thermoacoustic cooling device comprising:

a housing;

a transducer, said transducer disposed within said housing;

a first heat exchanger, said first heat exchanger disposed within said housing;

a semiconductor device, said semiconductor device disposed within said housing and connected to said first heat exchanger;

a second heat exchanger, said second heat exchanger disposed within said housing; and a thermal stack comprising a piece of porous material, said thermal stack having pore space, said thermal stack disposed within said housing such that said thermal stack directly adjoins said first heat exchanger and such that thermal stack directly adjoins said second heat exchanger such that a gas may be dispersed throughout said housing and throughout said pore space of said thermal stack such that, upon the activation of said transducer and said semiconductor device, an oscillating wave form may be produced within said gas so as to compress and decompress said gas so as to form a temperature gradient within said thermal stack, and such that said semiconductor device generates heat, and such that said heat of said semiconductor device is transferred through said gas to said second heat exchanger.

16. The semiconductor package of claim 15 wherein said first heat exchanger comprises a thermally conductive open cell foam material.

17. The semiconductor package of claim 15 wherein said thermal stack comprises reticulated vitreous carbon.

18. A micro-thermoacoustic device comprising:

a housing;

a transducer, said transducer disposed within said housing;

a first heat exchanger, said first heat exchanger disposed within said housing;

a second heat exchanger, said second heat exchanger disposed within said housing; and a thermal stack comprising a single piece of porous material, said thermal stack having pore space, said thermal stack disposed within said housing such that said thermal stack directly adjoins said first heat exchanger and such that thermal stack directly adjoins said second heat exchanger such that a gas may be dispersed throughout said housing and throughout said pore space of said thermal stack such that, upon the activation of said transducer, an oscillating wave form is produced within said gas so as to compress and decompress said gas so as to form a temperature gradient within said thermal stack.

19. The micro-thermoacoustic device as recited in claim 18 wherein said transducer has a frequency and wherein said frequency is greater than one kilohertz.

20. The micro-thermoacoustic device as recited in claim 18 wherein said single piece of porous material comprises reticulated vitreous carbon.

21. The micro-thermoacoustic device as recited in claim 18 wherein said single piece of porous material comprises a piece of porous carbon material and wherein said single piece of material is formed by cutting a piece of reticulated vitreous carbon material.

22. The micro-thermoacoustic device as recited in claim 18 wherein said single piece of material comprises a piece of porous carbon material and wherein said single piece of material is formed by machining a piece of reticulated vitreous carbon material.

23. The micro-thermoacoustic device as recited in claim 18 wherein said single piece of material has a shape and wherein said shape is cylindrical.

24. The micro-thermoacoustic device as recited in claim 18 wherein said first heat exchanger comprises diamond.

25. The micro-thermoacoustic device as recited in claim 18 wherein said housing has a length and a diameter and wherein said diameter is less than one centimeter and wherein said length is less than fifteen centimeters.

26. The micro-thermoacoustic device as recited in claim 18 wherein said housing has a diameter and wherein said housing has a length and wherein said length is approximately twelve centimeters and wherein said diameter is approximately one centimeter.

27. The micro-thermoacoustic device as recited in claim 18 wherein said single piece of material has an internal structure which includes pin shaped elements and wherein said pin shaped elements have surfaces, said surfaces of said pin shaped elements being rounded.

28. The micro-thermoacoustic device as recited in claim 27 wherein said surfaces of said pin shaped elements define a surface area and wherein said surface area is easily altered by forming said single piece of material from a piece of material having the required surface area.

29. The micro-thermoacoustic device as recited in claim 27 wherein said pin shaped elements of said single piece of material defines a plurality of circular structures, and wherein said number of circular structures is easily altered by forming said single piece of material from a piece of material having the required number of circular structures per linear inch.

30. The thermal stack for a micro-thermoacoustic device of claim 29 wherein said transducer operates at a frequency of approximately two kilohertz.

31. A thermoacoustic device comprising:

a housing;

a transducer, said transducer disposed within said housing;

a heat exchanger comprising a piece of thermally conductive open cell foam, said piece of thermally conductive open cell foam having pore space, said heat exchanger disposed within said housing; and a thermal stack, said thermal stack having pore space, said thermal stack disposed within said housing such that said thermal stack directly adjoins said first heat exchanger such that a gas may be dispersed throughout said housing and throughout said pore space of said thermal stack and throughout said pore space of said heat exchanger such that, upon the activation of said transducer, a temperature gradient is formed within said thermal stack such that heat may be transferred to said thermal stack by said heat exchanger.

32. The thermoacoustic device of claim 31 further comprising a heat exchanger for heat removal, said heat exchanger for heat removal including open cell foam material, said heat exchanger for heat removal disposed within said housing such that heat may be moved out of said device through said heat exchanger for heat removal.

33. The thermoacoustic device of claim 31 wherein said piece of thermally conductive open cell foam comprises a metal foam.

34. The thermoacoustic device of claim 32 wherein said heat exchanger includes a first retainer ring and a first heat conducting element and wherein heat is moved into said thermoacoustic device through said first heat conducting element and wherein said heat exchanger for heat removal includes a second retainer ring and a second heat conducting element, and wherein heat is moved out of said thermoacoustic device through said second heat conducting element.

35. The thermoacoustic device of claim 31 wherein said piece of thermally conductive open cell foam comprises a aluminum foam.

36. The thermoacoustic device of claim 31 wherein said piece of thermally conductive open cell foam comprises a copper foam.

37. The thermoacoustic device of claim 31 wherein said piece of thermally conductive open cell foam comprises a silver foam.

38. The thermal stack for a micro-thermoacoustic device of claim 31 wherein said solid piece of porous material has a shape and wherein said shape has two ends, a length and a central region and wherein said diameter varies along the length of said piece of material such that each of said ends has a diameter and such that said central region has a diameter and wherein said central region has a diameter greater than said diameter of each of said ends.

39. A micro-thermoacoustic cooling device comprising:

a cylindrical housing having an enclosed end and an open end;

a micro-transducer, said micro-transducer disposed within said housing such that said micro-transducer lies within said open end of said housing so as to enclose said open end of said housing;

a first heat exchanger comprising a piece of porous material, said first heat exchanger disposed within said housing, said first heat exchanger including a region containing openings such that said gas may pass through said region of said first heat exchanger containing said openings;

a second heat exchanger comprising a piece of porous material, said second heat exchanger disposed within said housing, said second heat exchanger including a region containing openings such that said gas may pass through said region of said second heat exchanger containing said openings; and a thermal stack comprising a single piece of reticulated vitreous carbon, said thermal stack having pore space, said thermal stack disposed within said housing such that said thermal stack directly adjoins said first heat exchanger and such that thermal stack directly adjoins said second heat exchanger, such that a gas may be disposed within said pore space of said thermal stack such that, upon the activation of said micro-transducer, a wave form is produced so as to form a temperature gradient within said thermal stack such that, upon the transfer of heat to said first heat exchanger, said heat transferred to said first heat exchanger is transferred through said gas disposed within said pore space of said thermal stack to said second heat exchanger.

40. The micro-thermoacoustic device of claim 39 wherein said thermal stack is formed by machining a single piece of reticulated vitreous carbon material.

41. The micro-thermoacoustic device of claim 40 wherein said first heat exchanger comprises a thermally conductive open cell foam material.

42. The micro-thermoacoustic device of claim 40 wherein said second heat exchanger comprises a thermally conductive open cell foam material.

* * * * *